US005421707A

United States Patent [19]

Daniels

[11] Patent Number: 5,421,707

[45] Date of Patent: Jun. 6, 1995

[54] SCROLL TYPE MACHINE WITH IMPROVED WRAP RADIALLY OUTER TIP

[75] Inventor: Michael E. Daniels, Amherst, N.Y.

[73] Assignee: General Motors Corporation, Detroit, Mich.

[21] Appl. No.: 206,698

[22] Filed: Mar. 7, 1994

[51] Int. Cl.[6] ..... F04C 18/04; F04C 27/00

[52] U.S. Cl. ..... 418/55.2; 418/55.4; 418/142

[58] Field of Search ..... 418/55.2, 55.4, 142

[56] References Cited

U.S. PATENT DOCUMENTS

| | | | |
|---|---|---|---|
| 4,627,799 | 12/1986 | Terauchi | 418/55.4 |
| 4,722,676 | 2/1988 | Sugimoto | 418/55.4 |
| 4,859,159 | 8/1989 | Leptien | 418/55.2 |
| 5,059,102 | 10/1991 | Tokumitsu et al. | 418/55.2 |
| 5,226,233 | 7/1993 | D'Amico | 29/888.022 |
| 5,249,943 | 10/1993 | Kuroki et al. | 418/55.2 |

FOREIGN PATENT DOCUMENTS

| | | | |
|---|---|---|---|
| 58-172405 | 10/1983 | Japan | 418/55.2 |
| 62-107283 | 5/1987 | Japan | 418/55.2 |
| 1227886 | 9/1989 | Japan | 418/55.2 |
| 5164067 | 6/1993 | Japan | 418/55.2 |

*Primary Examiner*—John J. Vrablik
*Attorney, Agent, or Firm*—Patrick M. Griffin

[57] ABSTRACT

A scroll compressor 10 having a fixed scroll 18, an orbital scroll 70 and a drive 90 and 94 for moving the orbital scroll in a generally circular orbit. The scrolls 18 and 70 have end plates 24 and 72, with flat surfaces 26 and 76 and involute wraps 28 and 74. The wraps have inside flank surfaces 30 and 77, outside flank surfaces 32 and 78 and axial tips 34 and 80. A portion 164 of the axial tip 34 of the fixed scroll 18 adjacent the outside flank surface 32 is recessed from an adjacent portion of the axial tip that is adjacent to the inside flank surface 30. A portion 170 of the axial tip 80 of the orbital scroll 70 adjacent outside flank surface 78 has a surface in a plane that is recessed from an adjacent portion of the axial tip that is adjacent to the inside flank surface 77.

2 Claims, 3 Drawing Sheets

SCROLL TYPE MACHINE WITH IMPROVED WRAP RADIALLY OUTER TIP

TECHNICAL FIELD

The invention relates to a scroll type fluid displacement apparatus with two scrolls having end plates and spiral wraps and a drive that moves the scrolls in an orbital path relative to each other to compress, pump, or expand fluids.

BACKGROUND OF THE INVENTION

The scroll type fluid displacement apparatus has two scrolls. Each scroll includes an end plate and a spiral wrap. The wrap is attached to the end plate and includes two flank surfaces and an axial tip. The wrap which is found in many scroll type machines is an involute spiral. The two scrolls are positioned relative to each other so that the wraps and the end plates cooperate to form one or more fluid chambers. The scrolls are driven in an orbital path relative to each other to move the fluid in the chambers. If the orbital movement moves fluid from the central portion of the scrolls toward the radially outer edge, the fluid is generally being expanded. If the orbital movement moves fluid from the radially outer portion of the scrolls toward the central portion of the scrolls, the fluid is generally being compressed or pumped.

Two scrolls can be rotated about parallel axes that are displaced from each other to obtain the required orbital movement relative to each other. Relative orbital movement can also be obtained by holding one scroll in a fixed position and driving the other scroll in an orbital path.

Scroll type fluid displacement machines often employ scrolls that form at least one pair of fluid pockets. The fluid pockets are bound by flank surfaces of the wraps and by surfaces of the end plates. For these machines to efficiently compress, pump or expand fluids, the fluid pockets must be sealed to reduce fluid leaks. The flank surfaces of the wraps are smooth and accurately shaped so that contact between them will at least limit fluid leaks. The axial tips of the wraps and the surface of the end plates can also be accurately shaped to limit fluid leaks when the scrolls are at a uniform temperature.

During pumping, expansion or compression of fluids, the fluid temperature changes. The change in fluid temperature as the pressure changes in the fluid pockets changes the temperature of the scrolls. The temperature change generally results in the temperature at the center of the scrolls being higher than the temperature at the radially outer edges of the scrolls. This temperature variation across the scrolls results in variations in the axial height of the wraps due to thermal expansion and contraction. The variation and change in height of the wraps must be accommodated to prevent leakage of fluid between the axial tips of the wraps and the surfaces of the end plate. Axial expansion of the wraps can result in the axial tips of the wraps exerting sufficient force against the adjacent scroll end plate to cause excessive wear and frictional load.

Fluid leakage between the wrap flank surfaces of one scroll and the wrap flank surfaces of another scroll is controlled by contacts between the flank surfaces. The flanks of scroll wraps are accurately formed, their surfaces are smooth and may even have special coatings. The drive systems employed are designed to maintain contact between the flank surfaces during orbital movement of a pair of scrolls relative to each other without causing wrap damage.

Fluid leakage between the axial tips of the wraps and the surfaces of the end plates is controlled by axial tip seals. Axial tip seals have been used which are resilient or spring biased so that the seals accommodate thermal expansion and contraction of the wraps and remain in sealing contact with the surfaces of the end plates. Seals which are free to float in a tip seal groove have also been used. The fluids in the fluid pockets hold the floating seals in sealing contact with the surfaces of the end plates during operation.

Axial tip seals are held in a tip seal groove or groove sections in the axial tip of each scroll wrap. A tip seal groove can not extend all the way to the end of a wrap in the center portion of a scroll or to the radially outer end of a wrap. The ends of a groove need to be closed to retain the axial tip seal. It is also desirable to close the ends of a tip seal groove to prevent the tip seal groove from becoming a conduit for fluid leakage. The radially outer end of scroll wraps generally have less radial thickness. The radial thickness of the wraps can be reduced at the radially outer end because only the inner flank surface of the wrap has to be machined to make sealing contact with a flank surface on the adjacent scroll wrap. The force exerted on the flanks of scroll wraps by fluid in the fluid pockets is generally less at the radially outer end of the wraps than it is on the wrap flanks near the center of the scrolls. Reduction of wrap thickness at the radially outer end where less strength is required reduces scroll weight, reduces scroll diameter and reduces the weight of balance weights required to balance orbital movement.

Axial tip seals create a drag which resists sliding along the surfaces of the end plates. This drag increases the drive torque required, increases tip seal and end plate surface wear, can brake wraps from end plates and causes heating. Heating of the tip seals and the scrolls can shorten the life of fluid displacement apparatus. Contact between end plates and the axial tips of scroll wraps also creates a drag that increases drive torque, heat generation and wear. The greater the area of surface contact, the greater the drag force, but the sealing effect does not increase proportionately.

Lubrication is commonly employed to reduce drag. Lubricants also reduce wear, increase tip seal life and improve sealing. Under some circumstances a thin film of lubricant can increase drag due to the shear strength of thin oil films.

SUMMARY OF THE INVENTION

An object of the invention is to provide a scroll type fluid displacement machine with reduced drag and heat generation.

A further object of the invention is to improve sealing in a scroll type fluid displacement machine.

Another object of the invention is to provide scrolls for a scroll type fluid displacement machine which are easier and less expensive to manufacture.

A still further object of the invention is to increase the useful life and durability of a scroll type fluid displacement machine.

The fluid displacement apparatus includes a housing with a front section and a rear section. The rear section includes an integral fixed scroll with an end plate with a flat surface and an integral involute wrap. An exhaust chamber and an inlet passage are also integral with the rear section of the housing. An anti-wear plate is seated on the flat surface of the end plate of the fixed scroll. A tip seal is provided in the tip seal groove in the axial tip of the wrap.

An orbital scroll with an end plate and an involute spiral wrap is mounted in the front section of the housing. The orbital scroll wrap has a tip seal groove and a tip seal that seals against the anti-wear plate on the integral fixed scroll. The end plate of the orbital scroll includes a flat surface that seals against the tip seal carried by the integral fixed scroll wrap. The orbital scroll end plate also has a bore in a boss for an eccentric bushing.

An eccentric bushing is journaled in the bore in the orbital scroll end plate. A crankshaft is journaled in the front section of the housing and connected to the eccentric bushing to drive the orbital scroll in a generally circular orbit.

An electromagnetic clutch is connected to the crankshaft outside the housing for selectively transmitting torque to the crankshaft from a drive pulley when the clutch is engaged.

Balance weights in the front section of the housing balance the crankshaft and the orbital scroll. Balance weights can also be provided on the electromagnetic clutch.

An axial thrust and anti-rotation assembly is mounted in the front section of the housing. Axial thrust loads on the orbital scroll from fluid in the fluid pockets is transferred from the orbital scroll to the front section of the housing by the axial thrust and anti-rotation assembly. In addition to transferring axial thrust loads, the assembly limits axial separation of the scrolls and keeps the tip seals in sealing contact with the flat surface of the end plates. The axial thrust and anti-rotation assembly also limits the orbital scroll to orbital movement.

The axial tips of the scrolls each have tip seal grooves. The tip seal grooves end some distance from the radially outer end of each wrap. A portion of the axial tip surface adjacent to the outer flank surface is removed from each wrap to leave an inside axial tip surface that is narrower than the width of the wrap from a position near an end of the tip seal groove to the radially outer end of the wrap.

The above and further objects, features and aspects of the invention will become more apparent from the following description of the preferred embodiment and the drawing.

DESCRIPTION OF THE PREFERRED EMBODIMENT

Figure 1:
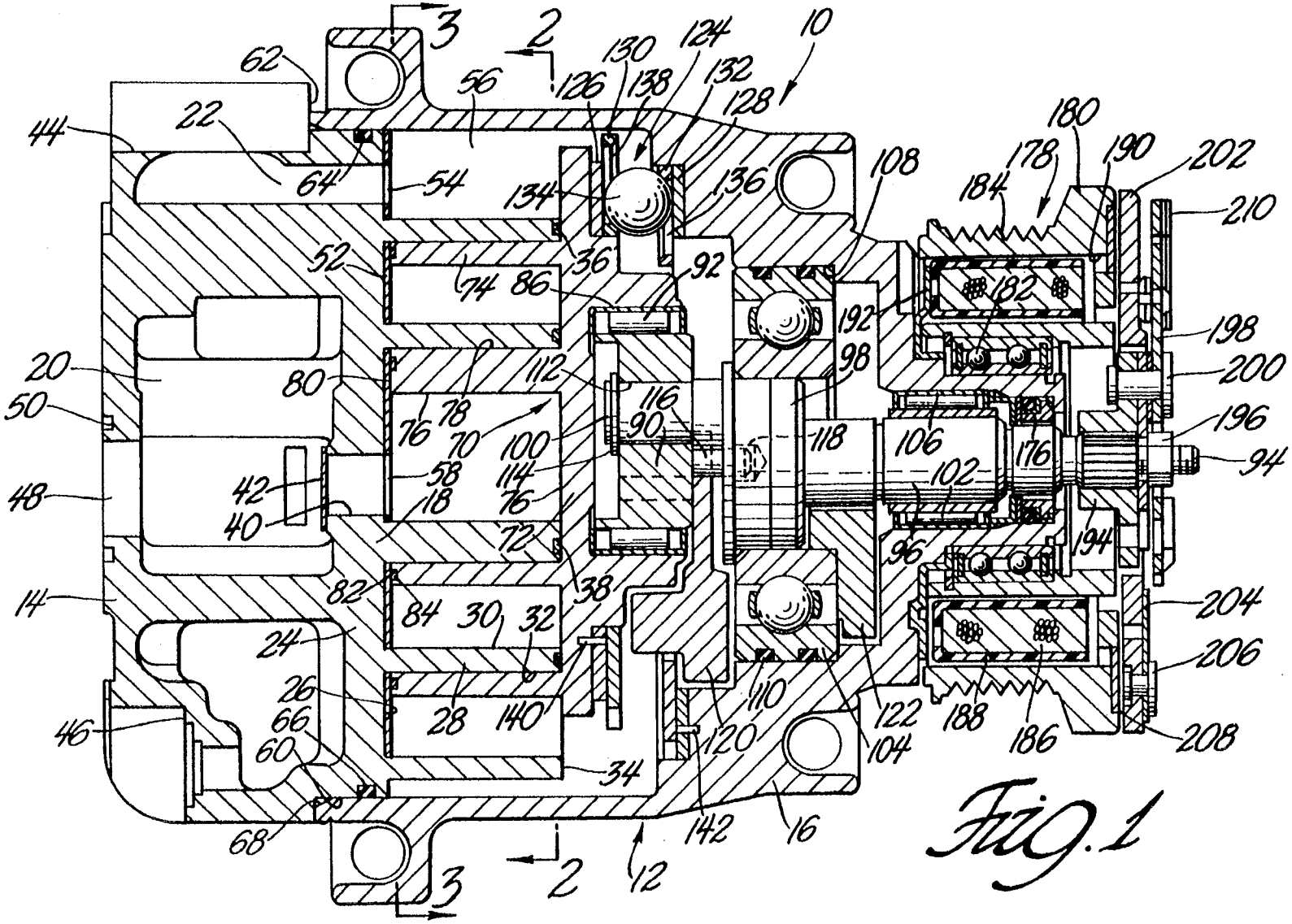
FIG. 1 is a vertical sectional view of a scroll type fluid displacement apparatus with scrolls that embody the invention.

The scroll type fluid displacement apparatus, shown in the Drawing and described below is a compressor. The compressor has been designed for use in a mobile air conditioning system. With minor modifications which would be obvious to designers of scroll type fluid displacement machines, the improved scrolls could be used in a pump, an expander or a stationary compressor.

The scroll type compressor 10, as shown in FIG. 1 includes a housing 12. The housing 12 includes a rear section 14 and a front section 16. The rear section 14 has an integral fixed scroll 18 with an exhaust chamber 20 and an inlet passage 22. The integral fixed scroll 18 includes an end plate 24 with a flat surface 26 and an involute spiral wrap 28. The involute wrap 28 has an inside flank surface 30, an outside flank surface 32 and an axial tip 34. There is a tip seal groove 36 in a portion of the axial tip 34. A tip seal 38 is retained in the tip seal groove 36.

An exhaust aperture 40 is provided in the center portion of the end plate 24. A reed valve 42 prevents fluid flow from the exhaust chamber 20, through the exhaust aperture 40 and into the exhaust chamber 20. A flat surface 46 is provided on the rear housing section 14 for the connection of a fluid discharge pipe. An access opening 48 in the rear wall of the exhaust chamber 20 is used to install the reed valve 42. During use of the scroll type compressor 10, the access opening 48 is closed by a plate and sealed by a rubber o-ring in the groove 50. The access opening 48 could serve as an alternate outlet port if desired.

An anti-wear plate 52 is positioned against the flat surface 26 of the end plate 24. The anti-wear plate 52 is made from a hard material such as steel. An opening 54 is provided in the anti-wear plate 52 for the passage of fluid from the inlet passage 22 to the scroll inlet chamber 56. Another opening 58 in the anti-wear plate 52 allows fluid to pass through exhaust aperture 40 in the end plate 24 past the reed valve 42 and into the exhaust chamber 20.

The front section 16 of the housing 12 telescopes over a drum shaped surface 60 on the rear section 14 of the housing 12 and contacts a front section abutment surface 62. The connection between the front section 16 and the rear section 14 of the housing is sealed by a rubber o-ring 64 in a groove 66. Beveled surface 68 insures that the o-ring 64 is cammed into the groove 66 during assembly. The housing 12 is held together by bolts which are not shown.

An orbital scroll 70 is mounted in the front section 16 of the housing 12. The orbital scroll 70 includes an end plate 72 and an involute wrap 74. The end plate 72 has a flat surface 76 which contacts the axial tip 34 or the tip seal 38 in the tip seal groove 36 in the involute wrap 28 of the integral fixed scroll 18. The involute wrap 74 has an inside flank surface 77, an outside flank surface 78 and an axial tip 80. A tip seal groove 82, in the axial tip 80, extends part of the length of the involute wrap 74. A tip seal 84 is retained in the tip seal groove 82. The tip seal 84 slides along the flat surface of the anti-wear plate 52.

The anti-wear plate 52 is required on the integral fixed scroll 18 because the fixed scroll is an unanodized aluminum alloy. An anti-wear plate is not required on the orbital scroll 70 because it is an anodized aluminum alloy that is resistant to wear.

A bore 86 in a boss 88 on the end plate 72 of the orbital scroll 70 contains an eccentric bushing 90. The eccentric bushing 90 is rotatably journaled in the bore 86 by a needle bearing 92. The eccentric bushing 90 is rotated by a crankshaft 94. The crankshaft 94 includes a shaft section 96, a co-axial flange 98 and a drive stud 100 having an axis that is offset to the side of the shaft section 96. The shaft section 96 is rotatably journaled by a needle bearing 102 and the co-axial flange 98 is rotatably journaled by a ball bearing 104. The needle bearing 102 is mounted in a bore 106 in the front section 16 of the housing 12. The ball bearing 104 is mounted in a bore 108 in the front section 16 of the housing. Two fiber rings 110 keep the ball bearing 104 tight in the bore 108 even when the housing 12 expands due to increased temperature.

The drive stud 100 passes through a bore 112 in the eccentric bushing 90. A c-clip 114 holds the eccentric bushing 90 on the drive stud 100. A pin 116 is integral with and extends from the eccentric bushing 90. The pin 116 is loosely received in a bore 118 in the co-axial flange 98 to limit pivotal movement of the eccentric bushing 90 relative to the crankshaft 94.

A balance weight 120, primarily for balancing the orbital movement of the orbital scroll 70, is attached to the eccentric bushing 90 and rotates with the bushing. A balance weight 122 is connected to the crankshaft 94 for balancing the crankshaft.

An axial thrust and anti-rotation assembly 124 is positioned in the front section 16 of the housing 12. The axial thrust and anti-rotation assembly 124 includes two flat ring races 126 and 128, two apertured rings 130 and 132 and sixteen thrust balls 134. The apertured rings 130 and 132 each have sixteen apertures 136 with chamfered surfaces 138. A flat ring race 126 and an apertured ring 130 are secured to the orbital scroll 70 by pins 140. A flat ring race 128 and an apertured ring 132 are secured to the front section 16 of the housing 12 by pins 142. The sixteen thrust balls are positioned between the two flat ring races 130 and 132 to limit axial movement of the orbital scroll 70 away from the integral fixed scroll 18. Each of the sixteen thrust ball 134 is also positioned in one of the apertures 136 in aperture ring 130 and in one of the aperture 136 in aperture ring 132. The thrust balls 134 roll along the surfaces of the two flat thrust ring races 126 and 128 in generally circular orbits. The radius of the orbits is limited by contact between the thrust balls and the chamfered surfaces 138. Contact between the thrust balls 134 and the chamfered surfaces 138 confine the orbital scroll 70 to orbital movement and prevent rotation of the orbital scroll.

Figure 2:
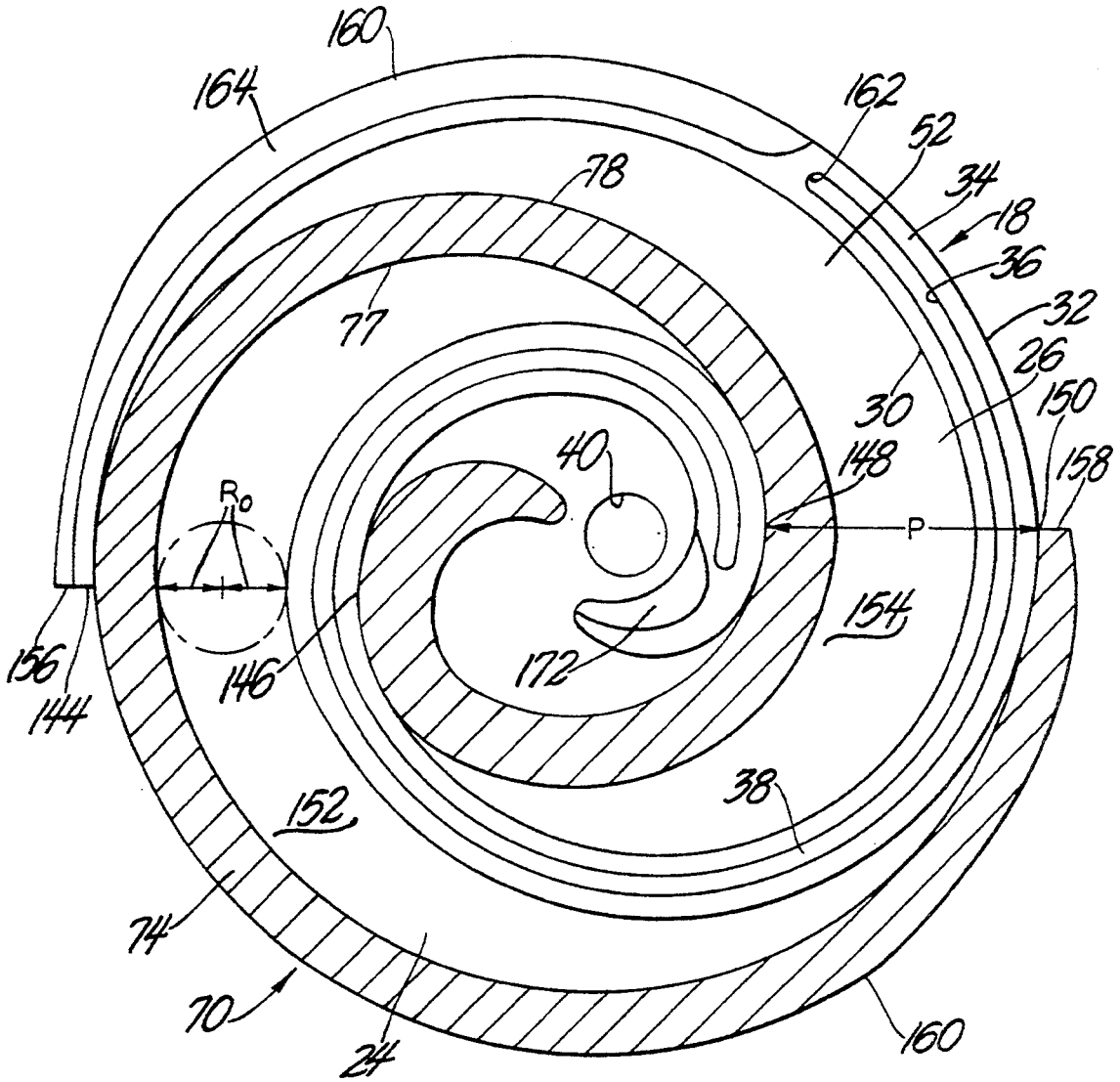
FIG. 2 is an enlarged cross sectional view of a pair of scrolls taken along the line 2—2 in FIG. 1.

The orbital scroll 70 is driven in a circular orbit with a radius $R_o$ shown in FIG. 2. When the pitch of the involute wraps is P, the thickness of the wrap 28 of the integral fixed scroll 18 is $t_1$ and the thickness of the wrap 74 of the orbital scroll 70 is $t_2$, the radius of the orbital scroll orbit is:

$$R_0 = P - t_1 - t_2/2$$

The radius $R_0$ of the orbital scroll orbit is the design radius. Due to variations in the manufacture of the parts of the compressor 10 and to wear of the parts during use, orbital movement of the orbital scroll 70 in a circular orbit with a radius $R_0$ would result in poor sealing between the flank surfaces 30, 32, 77 and 78 of the scroll involute wraps 28 and 74. To overcome this problem the eccentric bushing 90 is allowed to pivot slightly on the drive stud 100. The pivotal movement changes the actual radius of the orbit of the orbital scroll 70. This provision for automatic adjustment of the actual orbit radius allows the eccentric bushing 90 to continuously urge the flanks 77 and 78 of the wrap 74 on the orbital scroll 70 into contact with the flanks 30 and 32 of the wrap 28 on the integral fixed scroll 18.

The wrap 28 of the integral fixed scroll 18 has flank surfaces 30 and 32 which contact the flank surfaces 77 and 78 on the wrap 74 of the orbital scroll 70 along contact lines 144, 146, 148 and 150. The contacts along contact lines 144, 146, 148 and 150 together with sealing between the axial tip 34 and the flat surface 76 of the end plate 72 and between the axial tip 80 and a flat surface of the anti-wear plate 52 forms at least one pair of sealed pockets 152 and 154. Orbital movement in a clockwise direction, of the orbital scroll 70 in a generally circular orbit, as seen in FIG. 2, will cause the contact lines to move in a clock wise direction along the flanks 30 and 32 of the wrap 28 of the integral fixed scroll 18. This movement results in radial movement of the sealed fluid pockets 152 and 154 toward the center of the scrolls 18 and 70. As the sealed fluid pockets 152 and 154 move toward the center of the scrolls 18 and 70, their volume decreases and the pressure of fluid in the sealed fluid pockets increases. When the sealed fluid pockets 152 and 154 reach the center of the scrolls 18 and 70, compressed fluid in the sealed pockets is forced through exhaust aperture 40 and out of the scrolls.

The involute wrap 28 of the integral fixed scroll 18 has a radially outer end 156. The wrap 74 of the orbital scroll 70 has a radially outer end 158. During orbital movement of the orbital scroll 70, sealed fluid pockets 152 and 154 are formed during each orbit. The formation occurs when the orbital scroll reaches the position shown in FIG. 2. When the fluid pockets 152 and 154 are first formed, fluid pressure in the sealed fluid pockets 152 and 154 is the same as or slightly less than fluid pressure in the scroll inlet chamber 56. The forces exerted on flank surfaces 30 and 77 of the wraps 28 and 74 at the radially outer ends 156 and 158 is small. As orbital movement of the orbital scroll 70 continues from the position shown in FIG. 2, the radially outer ends 156 and 158 of the wraps 28 and 74 start to move out of the sealed fluid pockets 152 and 154. As the radially outer ends 156 and 158 move out of the sealed fluid pockets 152 and 154, the formation of new fluid pockets starts and fluid is sucked into the new pockets from scroll inlet chamber 56 until the new pockets are sealed when the orbital scroll 70 again reaches the position shown in FIG. 2 and starts a new fluid compression cycle.

The radially outer ends 156 and 158 of the wraps 28 and 74 do not require the strength that is required by portions of the wraps that are exposed to high fluid pressure. It is therefore possible to reduce the wrap thickness by tapering the outside flank surfaces 32 and 78 of the wraps 28 and 74 radially inward from a point 160 to the radially outer ends 156 and 158 of the wraps. This reduction in wrap thickness reduces the weight of the scrolls 18 and 70 and reduces the outside diameter of the scrolls. The reduced weight of the orbital scroll 70 reduces the size of the balance weight 120. The reduction in the outside diameter of the scrolls 18 and 70 allows a decrease in the size of the compressor housing 12 and can also increase the size of the scroll inlet chamber 56.

The axial tip 34 of the integral fixed scroll 18 has a tip seal groove 36. The tip seal groove 36 is generally in the center of the axial tip 34 and extends from a point near the radially inside end of the wrap 28 toward the radially outer end of the 156 of the wrap 28. The tip seal groove 36 is machined or cast in the axial tip 34 with sufficient depth to accommodate a tip seal 38. The tip seal groove 36 ends at a point 162 some distance from the radially outer end 156 of the wrap 28. A portion 164 of the axial tip 34 adjacent the outside flank surface 32 is removed. Removal of between 0.001 and 0.003 inches of material from the portion 164 of the axial tip 34 of the wrap 28 adjacent to the outside flank surface 32 reduces the drag on the orbital scroll 70 without reducing the strength of the wrap. The width of the axial tip 34 adjacent to the area 164 is about the same as the combined width of the axial tip 34 on both sides of the tip seal groove 36. By providing substantially the same amount of material to slide along the flat surface 76 of the end plate 72 the rate of wear is similar along the length of the wrap. Uniform wear tends to maintain good axial tip sealing. Sufficient material remains on the axial tip 34 of the wrap 28 adjacent to the area 164 where material is removed to provide good sealing in the low pressure area of the fixed scroll 18. A tip seal 38 is provided in the tip seal groove 36 where the pressure of fluid material in the scroll sealed fluid pockets 152 and 154 become relatively large.

Figure 3:
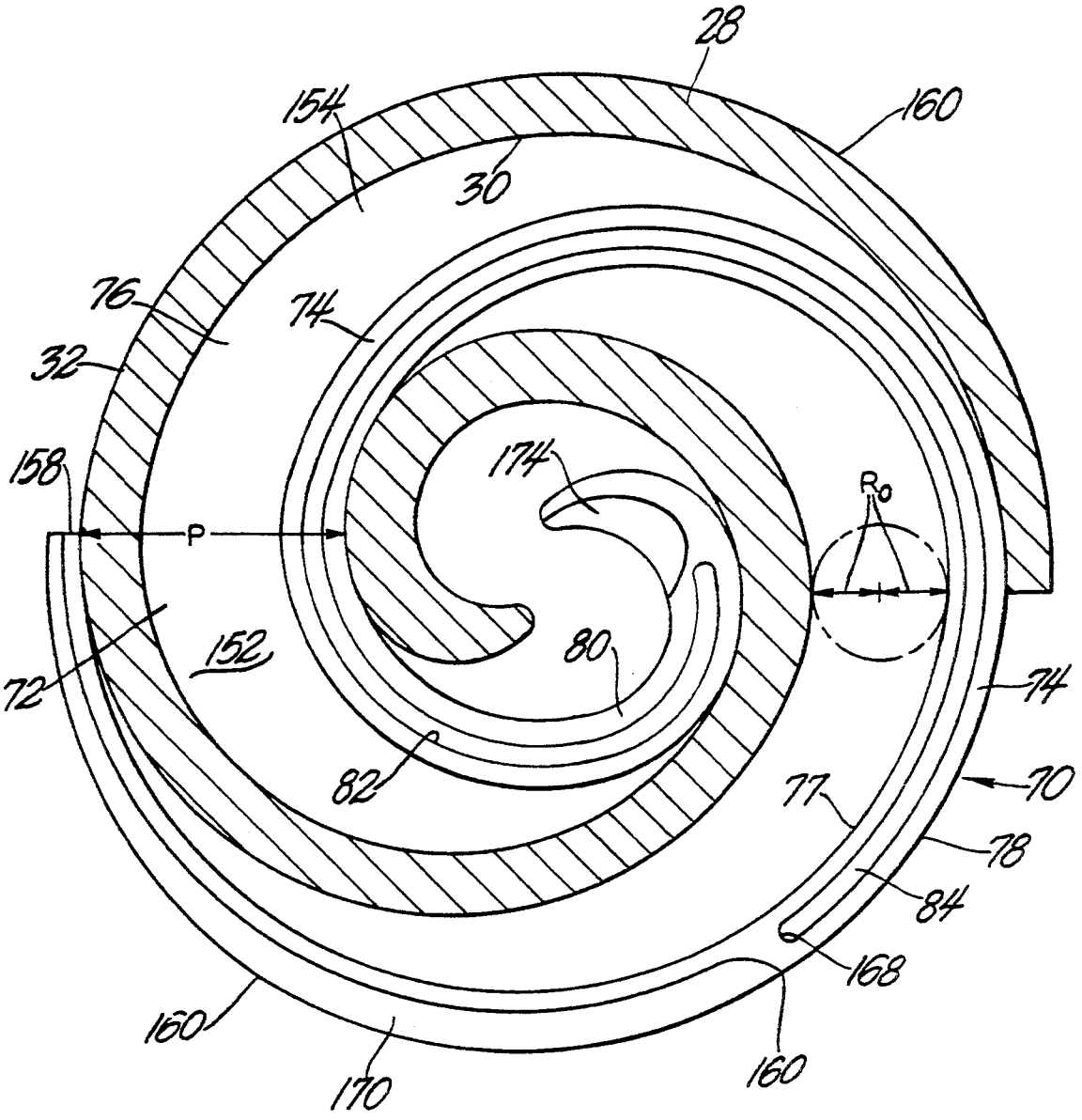
FIG. 3 is an enlarged rear view of the orbital scroll taken along line 3—3 in FIG. 1.

The orbital scroll 70, as shown in FIG. 3, has an end plate 72 with a flat surface 76 and an involute wrap 74. The involute wrap 74 has an inside flank surface 77 and an outside flank surface 78. The wrap 74 also has an axial tip 80, a tip seal groove 82 and a radially outer end 158. The tip seal groove 82 is generally in the center of the axial tip 80 and extends from a point near the radially inside end of the involute wrap 74 toward the radially outer end 158 of the wrap. The tip seal groove 82 is machined or cast in the axial tip 80 with sufficient depth to accommodate a tip seal 84. The tip seal groove 82 ends at a point 168 some distance from the radially outer end 158 of the wrap 74. A portion 170 of the axial tip 80 adjacent the outside flank surface 78 is removed. Removal of between 0.001 and 0.003 inches of material from the portion 170 of the axial tip 80 of the wrap 74 adjacent to the outside flank surface 78 reduces drag on the orbital scroll 70 without reducing the strength of the wrap. The radial width of the axial tip 80 adjacent to the portion 170 is about the same as the combined width of the axial tip 80 on both sides of the tip seal groove 82. By providing substantially the same amount of material to slide along the flat surface of the anti-wear plate 52, the rate of wear is similar along the length of the wrap. Uniform wear tends to maintain good sealing. Sufficient material remains on the axial tip 80 of the wrap 74 adjacent the portion 170 where material is removed to provide good sealing in the low pressure area of the orbital scroll 70. A tip seal 84 is provided in the tip seal groove 82 where the pressure of fluid material in the scroll sealed fluid pockets 152 and 154 becomes relatively large.

The radially inner ends of the wraps 28 and 74 on the fixed scroll 18 and the orbital scroll 70 are subject to large forces from high pressure fluid near the center of the scrolls. The thickness of the wraps 28 and 74 is increased at the radially inner ends to provide added strength. The high pressure fluid in the center portion of compressor scrolls has an elevated temperature. The fluid heats the scrolls and causes thermal expansion of the wraps 28 and 74. To accommodate the thermal expansion material is removed from an area 172 of the axial tip 34 of the wrap 28 and an area 174 of the axial tip 80 of the wrap 74. The amount of material removed is from about 0.001 to 0.003 inches. Removal of the material prevents the radially inner ends of the wraps 28 and 74 from damaging the scrolls 18 and 70 when they are at operating temperatures.

The crankshaft 94 extends outside the housing 12. A seal 176 is mounted in a bore adjacent to the needle bearing 102 to seal the opening where the crankshaft passes to the outside of the front section 16 of the housing 12. The crankshaft 94 is driven through a pulley and electromagnetic clutch assembly 178. The pulley and electromagnetic clutch assembly 178 includes a pulley assembly 180 rotatably supported on the housing 12 of the compressor 10 by a ball bearing 182. A series of v grooves 184 on the pulley assembly 180 are engagable with a power band belt which can rotate the pulley assembly about the axis of the crankshaft 94. A toroidal electromagnetic coil 186 is mounted inside a cavity in a toroidal ring 188 with a U-shaped cross section. The toroidal ring 188 is supported inside a cavity 190 in the pulley assembly 180 by a disk member 192 that is secured to the housing 12. A hub assembly 194 engages splines on the crankshaft 94 and is held on the crankshaft by a nut 196. A stop plate 198 is attached to the hub assembly 194 by rivets 200. An armature 202 is held against the stop plate 198 and secured to the hub assembly 194 by spring steel strips 204. Each spring steel strip 204 has an inner end that is secured to the hub assembly 194 by a rivet 200 and an outer end that is secured to the armature by a rivet 206. When the electromagnetic coil 186 is energized, a magnetic force is generated which deflects the spring steel strips 204 and pulls the armature 202 away from the stop plate 198 and into contact with a contact surface 208 on the pulley assembly 180. Upon contact between the armature 202 and the pulley assembly 180, the crankshaft 94 rotates with the pulley assembly. The electromagnetic clutch 178 can include a balance weight 210 attached to the stop plate 198.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. In a scroll type compressor of the type having a pair of oppositely axially extending, interleaved spiral wraps, each of which has a radially inner end, radially outer end, inside and outside flanks extending axially from flat end plates, an axial tip extending across said flanks with a radial width that is axially abutted with the end plate of the opposite spiral wrap, and in which the adjacent inner and outer flank surfaces of said interleaved wraps form pressurized fluid pockets sealed by sliding contact between said spiral wrap axial tips and opposed end plates, with a higher pressure region near said spiral wrap outer ends and a lower pressure region near said spiral wrap outer ends, the improvement comprising, a tip seal groove cut centrally along the axial tip of at least one of said spiral wraps from near said tip radially inner end to an end point well short of said tip radially outer end, said axial tip having uncut portions bordering either side of said tip seal groove adjacent the respective flanks, a tip seal located in said tip seal groove and compressed against the end plate of the opposed spiral wrap, and, a slightly axially recessed area on said spiral wrap axial tip extending from a point beyond the end point of said tip seal groove to said wrap radial outer end, said recessed area being adjacent to said wrap outer flank so as to leave a coextensive, unrecessed area of said axial tip having a radial width sufficient to substantially equal the radial width of the tip seal area bordering said tip seal groove and an axial depth large enough to prevent direct contact with said opposed end plate but small enough to leave the strength and weight of said spiral wrap substantially unaffected, whereby said fluid pocket is sealed by said tip seal in the higher pressure region, is sealed by contact between the unrecessed area of said and opposed end plate in said lower pressure region, and overall frictional wear between said axial tip and opposed end plate is reduced and balanced over the length of said axial tip by virtue of balancing the radial widths of the portions of said axial tip bordering said tip seal groove and adjacent said recessed area.

2. A scroll type compressor as claimed in claim 1 wherein said axially recessed tip seal portion has an axial depth ranging approximately between 0.001 and 0.003 thousandths of an inch.

* * * * *